US007044025B2

(12) United States Patent
Rohrich et al.

(10) Patent No.: US 7,044,025 B2
(45) Date of Patent: May 16, 2006

(54) RIM SPROCKET FOR CHAIN SAW

(75) Inventors: Thomas Rohrich, Beavercreek, OR (US); Anil Challapalli, Milwaukie, OR (US)

(73) Assignee: Blount, Inc., Portland, OR (US)

( * ) Notice: Subject to any disclaimer, the term of this patent is extended or adjusted under 35 U.S.C. 154(b) by 16 days.

(21) Appl. No.: 10/951,747

(22) Filed: Sep. 27, 2004

(65) Prior Publication Data

US 2006/0064880 A1 Mar. 30, 2006

(51) Int. Cl.
*B27B 13/00* (2006.01)

(52) U.S. Cl. ..... 76/29; 76/80.5

(58) Field of Classification Search ..... 76/29, 76/80.5, 30

See application file for complete search history.

(56) References Cited

U.S. PATENT DOCUMENTS 4,776,826 A 10/1988 Scott
4,816,010 A 3/1989 Reynolds
4,876,796 A 10/1989 Calkins et al.
4,893,407 A 1/1990 Lane
5,098,348 A 3/1992 O'Neel
5,136,783 A 8/1992 Bell

*Primary Examiner*—Charles Goodman

(57) ABSTRACT

Batch casting of rim sprockets for chain saws as particularly applied to larger rim sprockets experience undesired high scrap rate resulting from porosity and chip-out. The solution is to ensure flow of molten steel throughout solidification of the molten steel in the sprocket mold while retaining molten steel portals or gates of a size that permits breakaway of portal stems. Such enhances the cooling rate of the molten steel in the sprocket mold which was found beneficial. The objective of reduced scrap rate is thus accomplished by maintaining a ratio of mass to surface area of the sprockets being cast to no greater than about 4 grams of material to each square inch of surface area and alternatively provide through bores through the rim sprockets which additionally assist in wood chip removal. This design also reduces the material content which reduces the cost and weight of the product.

6 Claims, 4 Drawing Sheets

RIM SPROCKET FOR CHAIN SAW

FIELD OF INVENTION

This invention relates to a rim sprocket for driving a saw chain of a chainsaw, the saw chain comprising, e.g. center drive links connected to paired side links, certain ones of which are side cutting links, and more particularly to a structure for such rim sprocket that uses less material and is thus lighter in weight and equal or greater in strength. More particularly and/or additionally it relates to the process for producing the sprocket while reducing scrap rate.

BACKGROUND OF THE INVENTION

Rim sprockets can be described as having a star shaped center section (i.e., having radially extended teeth) positioned between disc shaped side walls. The spacings between the teeth circumferentially, and between the side walls laterally, define gullets that receive the drive tangs of center links of a saw chain, and the side walls further define outer peripheral support surfaces or rails which support the side links of the saw chain. The sprockets have a spline shaped center opening through the thickness of all three sections that receive a drive shaft, e.g. of an adapter driven by the chainsaw's engine. In an example of such a chainsaw, a centrifugal clutch driven by the engine engages the cup and rotates the adapter shaft to rotatively drive the rim sprocket and thus the saw chain mounted on the rim sprocket. The saw chain is thereby driven around a guide bar of the chainsaw for cutting trees or logs and the like.

The drive sprocket is a key component of the chainsaw's drive system and is subject to harsh abuse and rapid wearing. It is desired that the sprocket be made to withstand the severe abuse over many hours of use, e.g. the lifetime of several cutting chains and yet be produced as inexpensively as feasible.

A process has been developed for making such sprockets. A mold tree is formed. The mold tree is a plastic form with a vertical center section made of many interconnected segments having spokes radiating horizontally. Secured to each spoke is a sprocket mold or mold form, that is in the shape of the rim sprocket to be produced. This tree is coated with ceramic and the plastic form is burned away leaving a ceramic mold. Passageways are thereby provided down the center of the mold tree created by the burned out center section (referred to as a sprue) and through the burned out spokes (referred to as gates) and into each sprocket mold cavity. Molten steel is poured through the passageway and into the numerous sprocket mold cavities in a single operation. When cooled, the ceramic mold surrounding the solidified sprockets is removed but, notwithstanding, the sprockets remain interconnected via the steel that has hardened in the gates. The hardened steel formed in the gates is sometimes referred to as stems. As designed, the steel of the stem formed inside the gate and which is connected to the sprocket is small in dimension and the sprocket can be broken away from the hardened metal formed in the sprue. Any nubbin of the stem remaining on the sprocket can be readily ground away to remove any sign of the interconnection, and thus rendering the sprocket ready for final processing e.g. heat treating.

The process as described has a number of critical aspects and as a result there are problems that are herein addressed. The molten steel is desirably poured when at an established molten temperature to ensure complete filling of the mold forms and to ensure a desired steel composition of the end product. The stems generated at the gates should be configured so as to permit a clean break away of the solidified sprockets. The metal throughout the sprocket form is preferably uniformly dense, i.e., devoid of porosity. Other desirable features for the rim sprocket are that the sprockets as produced facilitate wood chip removal during a wood cutting operation, and that the weight of the sprocket be minimized.

BRIEF DESCRIPTION OF THE INVENTION

The present invention is derived from an investigation into an undesired high scrap rate that resulted particularly when molding larger sized rim sprockets, e.g. larger than 1½" diameter. It was determined that the higher scrap rate resulted largely due to the metal in the gates becoming solidified prematurely. Thus, it was reasoned that to insure a flow of sufficient metal into the larger cavities and thus avoid porosity, the gates or portals through the spokes needed to be enlarged. However, when enlarged, the larger stem that was formed inside the gate (following solidification of the metal) was more difficult to break away from the sprocket and resulted in occasional chipping out (chip-out) of a portion of the sprocket body.

Further investigation led to an attempt to reduce the metal quantity for the larger sized sprocket so as to retain the smaller portals. The configuration of the star shaped center section and the disc shaped side walls is dictated at least in part by the configuration of the saw chain being driven. The center opening is dictated by the adapter mounted to the cup that drives the sprocket. Thus, the initial attempts at reducing volume was to create channels in the side walls of the side sections. These attempts were successfull in that the metal volume was reduced, resulting in scrap rate reduction and sprockets thus produced were found to retain the desired strength. Such success inspired further attempts to reduce metal quantity and the side walls were provided with openings, in the axial direction between the sprocket teeth, and in a third stage of development the thickness of the side wall over the sprocket teeth was also reduced.

The above described metal removal and follow up testing led to a further discovery which was that certain of the thinner sections forming the rims were often stronger than, or at least as strong as, the predecessor thicker sections. Even further, wear life appeared to increase due to resultant harder surfaces in the stress critical areas. It was determined that the predecessor thicker sections were somewhat more porous and that such porosity was a phenomenon of the metal cooling and solidification process. As molten metal cools it solidifies and in the process it shrinks. Thus, additional molten metal needs to be provided throughout the shrinking process to maintain a more densely filled cavity. If not, interstices are created that produces the undesired porosity and lesser hard surface areas.

From the above trials and errors a critical relationship was discovered, i.e., a relationship of surface area of the sprocket being poured to the mass of the metal needed to fill the cavity of the sprocket mold. More specifically, the ratio of weight e.g. grams, to surface area e.g. square inches, should be on the order of 4 to 1 or less i.e. no greater than about 4 grams of molten metal for each square inch of surface area making up the exterior surface of the sprocket being poured. This desired relationship is achieved by reducing the thickness for the sprocket configuration in non-stress critical areas, and as feasible by increasing the surface area. From observations of the sprockets produced by the present invention, the more rapid cooling and solidification produces a lighter rim sprocket, is less expensive to produce, and furthermore is found to have a longer wear life. The invention will be more fully appreciated and understood with reference to the following detailed description of preferred embodiments of the invention, having reference to the accompanying drawings.

BRIEF DESCRIPTION OF THE DRAWINGS

FIG. 1 being a perspective view; FIG. 2 being an end view; FIG. 3 being a side view; FIG. 4 being a section view as taken on view lines 4—4 of FIG. 3; and FIG. 5 being a section view as taken on view lines 5—5 of FIG. 4;

DETAILED DESCRIPTION OF A PREFERRED EMBODIMENT OF THE INVENTION

Figure 15:
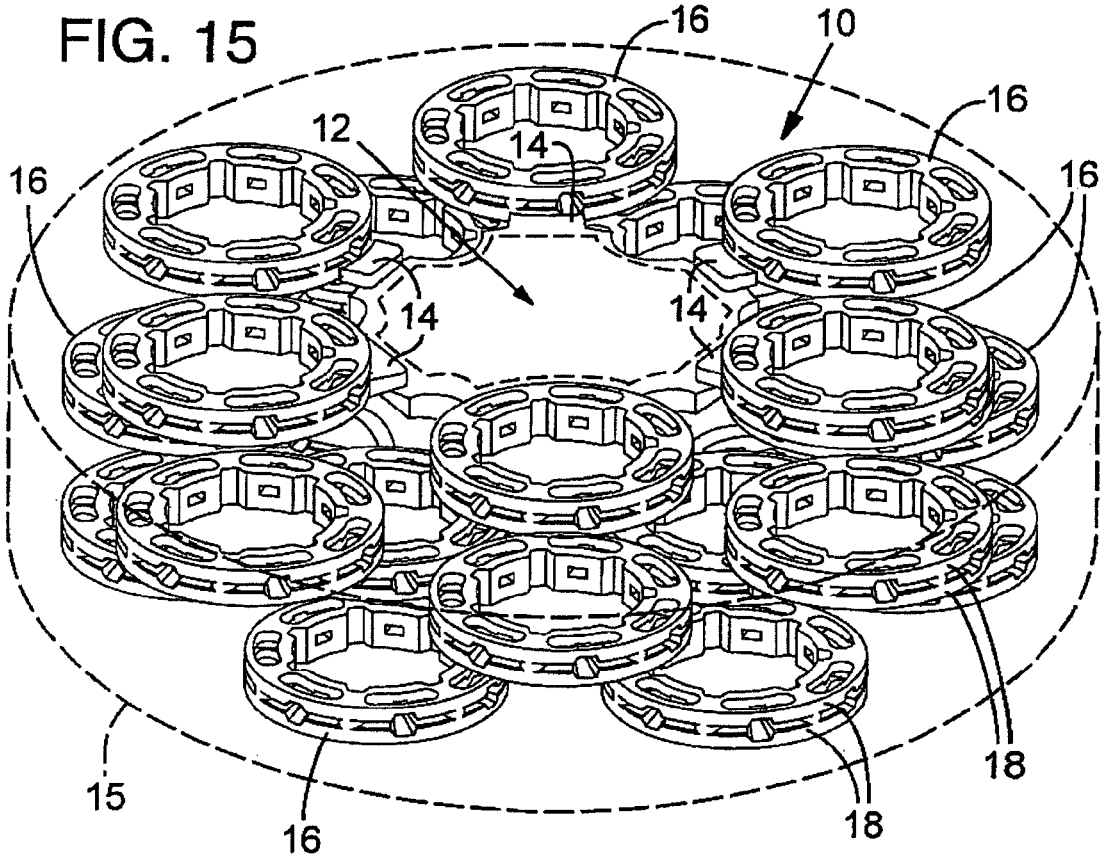
FIG. 15 is a pictorial view of a mold tree form representative of the process for producing the rim sprockets of FIGS. 1–14.

FIG. 15 illustrates a mold form 10 that is created from e.g. plastic, but also represents interconnected rim sprockets following the process of casting as will be explained. The mold form 10 is encased in a ceramic that withstands high temperatures. The encasement of ceramic is represented by dash line 15. The plastic is melted and removed, resulting in a ceramic mold having complex cavities substantially the size and shape of the mold form 10. Molten metal e.g. a steel composition, is poured down through a center sprue (as represented by arrow 12) and flows outwardly to and through portals or gates represented by stems or stem portions 14 of mold form 10 and into the outboard cavities represented by sprocket mold forms 16.

It will be noted that the stem portions 14 which represent the gates or portals of the mold casting are substantially the thickness of side walls 18 of the sprocket mold forms 16. It will be further appreciated that the molten steel (at e.g. 3,000 degrees F. or higher) flows from the sprue openings (12) through the gates (14) and then into the numerous cavity configurations (16) until the sprocket cavities are filled. Such filling requires but a very brief period of time. Then the molten steel cools and as it cools it shrinks and additional molten steel is drawn into the cavity configurations (16) through the gates (14). To the extent that the additional molten steel is available through the gates (14), the density of the steel desired for the sprocket cavity configurations (16) is maintained. Should the molten steel in the gates (14) solidify and thus close off the gates before the molten steel of the sprocket cavity configurations (16) solidifies, the continuing solidification of the steel in the cavities will result in a contraction or shrinking of the steel which generates interstices within the body of the sprocket and thus the undesired porosity.

Figure 1:
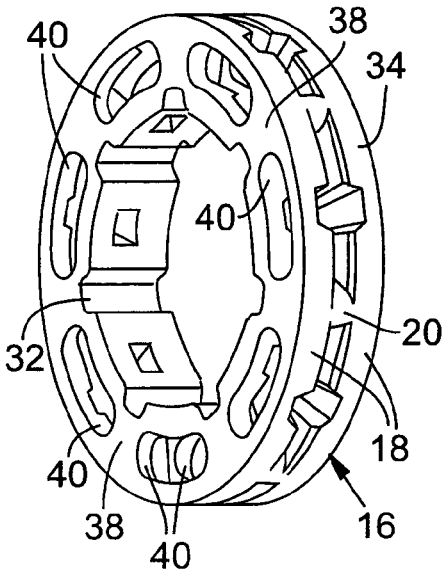
FIGS. 1–5 are various views of a rim sprocket in accordance with the invention.
Figure 2:
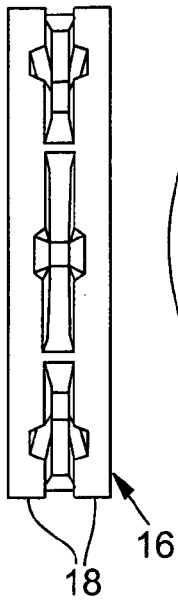

Reference is now made to FIGS. 1–5 which illustrate one embodiment of the invention. Whereas a typical rim sprocket has two planar disk shaped side walls 18 separated by a star shaped center section 20, and whereas the outer and inner peripheries of both side walls and center sections are determined respectively by the saw chain being driven by the sprocket (see dash line 26 of FIG. 5) and the drive shaft driving the sprocket (see dash lines 42 of FIG. 5), the applicant provides removal of material from the side walls but only between the outer and inner peripheries. More specifically and with reference particularly to FIG. 3, the outer and inner peripheral portions 34, 36 of side walls 18 (sometimes referred to as peripheral rails) are interconnected by connecting portions 38, which portions coincide with sprocket teeth 20 as best seen in FIG. 1. As will be noted, the spaces defined by portions 34, 36, and 38 provide through bores 28. (It should be also noted that the through bores 28 should not interrupt the tooth i.e. the side edge of the hole should be inboard of the tooth side edge. See FIG. 5. Otherwise it might cause a stress riser which produces cracks.)

Figure 3:
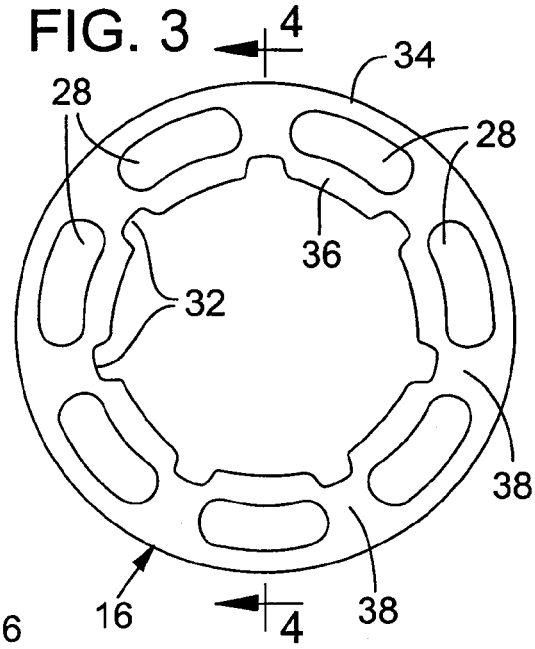
Figure 4:
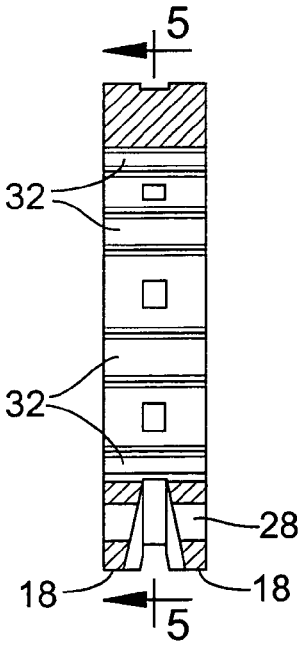

As will be apparent, such material removal accomplishes lowering the material mass of the sprocket while providing newly exposed surface areas, i.e., the area 40 surrounding the through bores 28 as best seen in FIGS. 1 and 3. The objective of this material removal is to lower the ratio of mass to surface area, e.g., to no greater mass than 4 grams of steel material per square inch of surface area.

Figure 5:
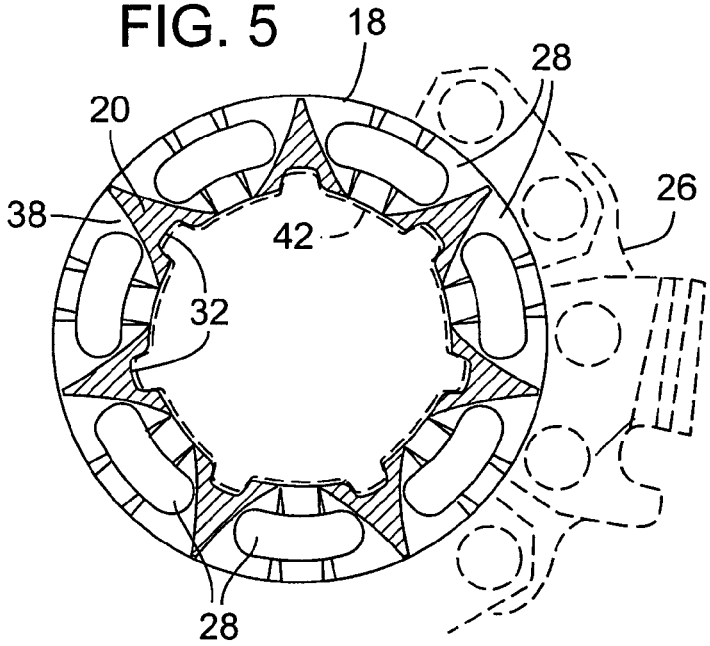
Figure 6:
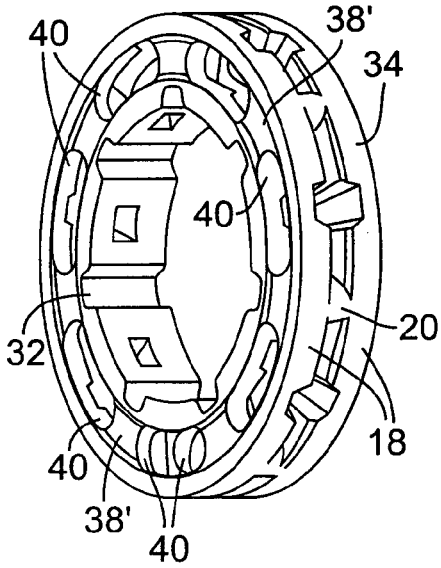
FIGS. 6–9 are similar views of an alternate embodiment.
Figure 7A:
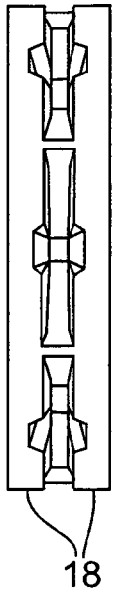
Figure 7B:
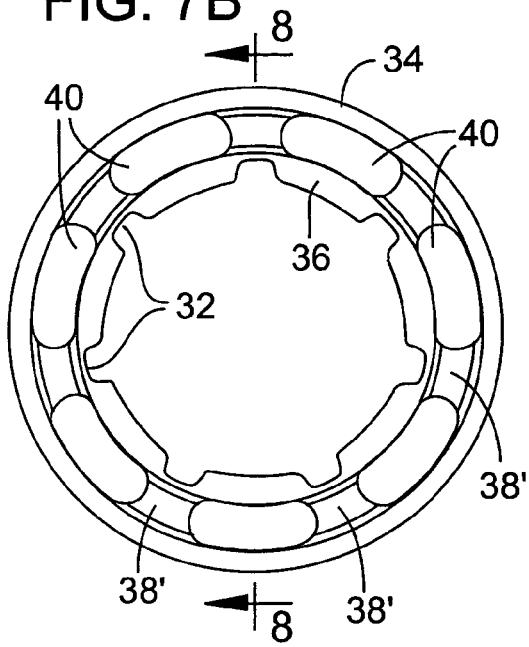
Figure 8:
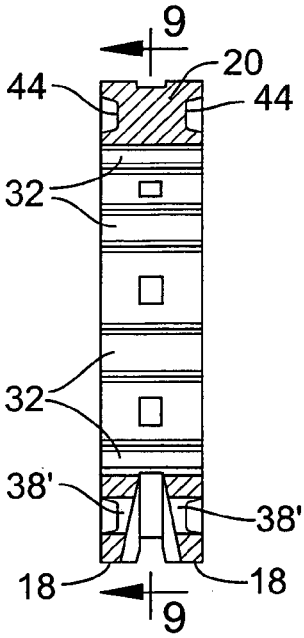
Figure 9:
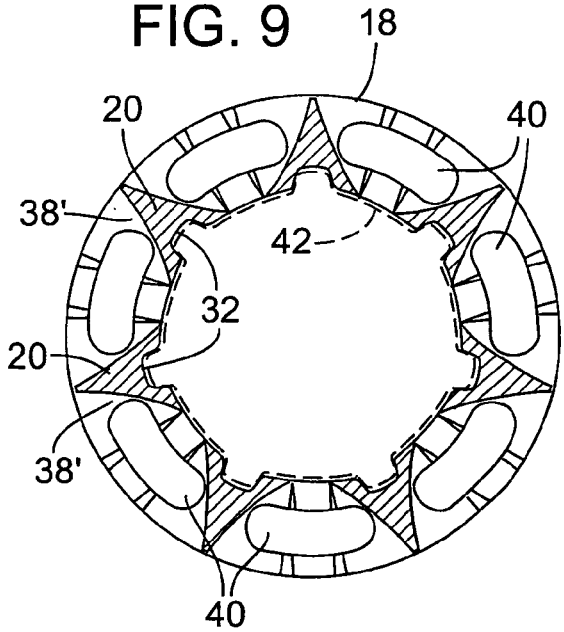

As indicated above and again having reference to FIGS. 1–5, the sprocket 16 is provided with through bores 28 that extend the full thickness of the sprocket, i.e., through both side walls 18. Metal material resides above, below and at each side of the through bores of both side walls 18. The center opening defined by drive shaft 42 is configured to have notches 32 that fit the splines of drive shaft 42 for transmitting rotative power from a chain saw engine to the sprocket and thus to a saw chain 26 entrained on the sprocket 16 as illustrated in FIG. 5.

The configuration of sprocket 16 would have previously been considered too fragile based on prior experiences in casting rim sprockets. However, as explained above, as a result of the need to reduce mass and the resultant finding that thicker was not always better, i.e., stronger, as applied to these metal castings (porous v. non-porous), it was found that providing through bores 28, in an area of low stress, reduced the mass of metal making up the sprocket. It did so without reduction in the size of the sprocket (i.e., having the same inner and exterior peripheral configurations and land surface area as required to support and drive a saw chain) and without sacrifice of strength. The greater surface area and lesser mass, in particular, enables sprockets of larger sizes, e.g. greater than 1.5" in diameter, to be produced while maintaining a desired mass to surface ratio. Through extensive experimentation, it has been determined that this ratio is desirably maintained at no greater than about 4 to 1, i.e., 4 grams of weight for every square inch of surface area.

Reference is now made to the alternate embodiment shown in FIGS. 6–9. This alternate embodiment has but one difference from that of FIGS. 1–5 which is the reduction in thickness of connecting portions 38' as compared to connecting portions 38 of FIGS. 1–5. It will be appreciated that designated teeth 20 and connecting portions 38 of the prior embodiment are cast as a common component of the sprocket. As between the two embodiments, the thickness of the combination 20, 38 is shown at maximum thickness in the first embodiment (FIGS. 1–5) and at about the minimum thickness in the second embodiment (FIGS. 6–9). It may well be preferred that an in between thickness could best serve the needs of the chain saw user and as such the full range of thicknesses as between these maximum and minimum thicknesses is encompassed within the teachings of the present disclosure.

Figure 10:
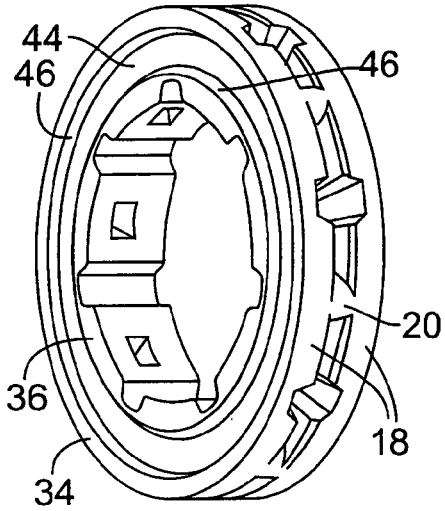
FIGS. 10–14 are similar views of a second alternate embodiment.
Figure 11:
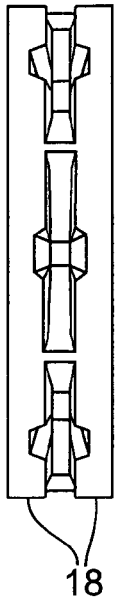
Figure 12:
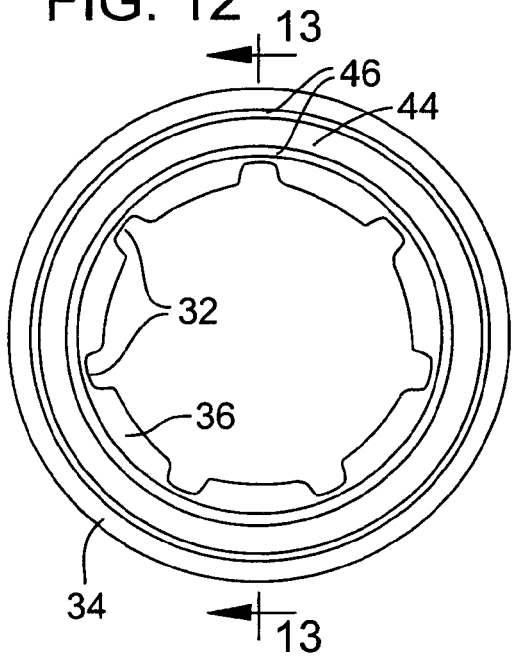
Figure 13:
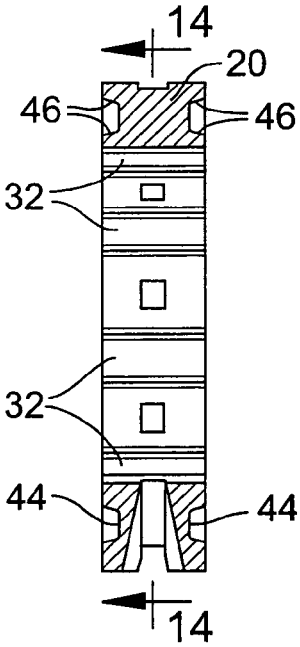
Figure 14:
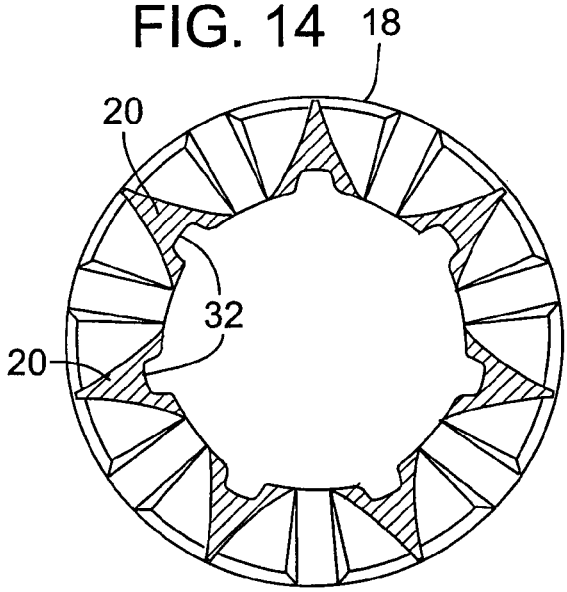

A third embodiment is shown in FIGS. 10–14. In this embodiment, the material between the outer peripheral portions 34 and the inner peripheral portions 36 (at both sides) are thinned, i.e., a channel or inset 44 is formed between the inner and outer peripheral portions, which peripheral portions may sometimes be referred to as inner and outer ring portions. As best seen in FIGS. 10, 12 and 13, the provision of such channels produces a reduction in the metal material and increase in surface area, e.g., the addition of transition surface areas 46.

The above disclosure is directed to preferred embodiments and subject to numerous variations and modifications without departing from the invention which is defined by the claims appended hereto, the terms of which are intended to be given their broad and customary meaning in the trade.

What is claimed is:

1. A rim sprocket for driving a saw chain of a chain saw, which rim sprocket is cast from molten steel in a batch casting process, said sprocket comprising:

spaced apart side walls connected together by circumferentially spaced teeth, said side walls having an outer periphery for supporting side links of the saw chain and the circumferentially spaced apart teeth receiving and engaging center drive link tangs of the saw chain, and said side walls having an inner periphery configured to receive a splined drive shaft of the chain saw for rotatably driving the sprocket, and through engagement of the teeth with the drive link tangs thereby driving the saw chain of the chain saw;

said side walls having continuous peripheral rings of metal defining said inner and outer peripheries and said side walls and teeth cooperatively configured to provide through bores between said teeth and extended through both side walls, said cooperatively configured side walls and teeth having a desired mass of material as compared to the outer surface area of the sprocket that is no greater than about 4 to 1 as measured in grams of weight to square inches of surface area.

2. A rim sprocket for driving a saw chain of a chain saw, which rim sprocket is cast from molten steel in a batch casting process, said sprocket comprising:

spaced apart side walls connected together by circumferentially spaced teeth, said side walls having an outer periphery for supporting side links of the saw chain and the circumferentially spaced apart teeth receiving and engaging center drive link tangs of the saw chain, and said side walls having an inner periphery configured to receive a splined drive shaft of the chain saw for rotatably driving the sprocket, and through engagement of the teeth with the drive link tangs thereby driving the saw chain of the chain saw;

said side walls having continuous peripheral rings of metal defining said inner and outer peripheries and said side walls between said continuous rings both being reduced in thickness to produce groove shaped insets and thereby increased surface area and reduced mass;

said mass to surface area having a ratio no greater than about 4 to 1 as measured in grams to square inches, and said drive sprockets having a size greater than 1½ inches in diameter.

3. A rim type drive sprocket as defined in claim 1 wherein the through bores in the side walls define connecting portions between the inner and outer rings and said connecting portions reduced in thickness as compared to the thickness of the inner and outer rings.

4. A method of producing rim sprockets for driving a saw chain of a chain saw which comprises:

producing a casting including a center sprue, multiple sprocket cavities and gates connecting the center sprue to the cavities;

producing said cavities to have side walls having outer and inner support rings as required to fit the drive shaft of a chain saw and to support side links of a saw chain and to further have sprocket teeth between said side walls for engaging drive tangs of said saw chain, said outer and inner support rings and said sprocket teeth being considered high stress critical components, and said outer and inner rings connected by non high stress connecting side wall portions; and reducing the thickness of said connecting portions as necessary to maintain a mass to surface area ratio of no greater than 4 grams of material per square inch of surface area.

5. A method as defined in claim 4 wherein the outer and inner support rings are interconnected by side walls and said sprocket teeth, and providing through bores through the thickness of said sprockets between the outer and inner support rings and between said sprocket teeth to reduce mass and enhance wood chip removal.

6. A method as defined by claim 4 which includes reducing the mass of said side wall portions by forming channels in said side walls and to further increase the exposed surface areas of said sprockets.

* * * * *